United States Patent [19]

Whitney et al.

[11] 3,939,518

[45] Feb. 24, 1976

[54] FLOOR TREATMENT MACHINE

[75] Inventors: Robert P. Whitney, Grand Haven; Melvin R. Smith, Muskegon, both of Mich.

[73] Assignee: Clarke-Gravely Corporation, Muskegon, Mich.

[22] Filed: Nov. 30, 1973

[21] Appl. No.: 420,433

[52] U.S. Cl. ..... 15/98; 15/320; 115/359; 15/401

[51] Int. Cl.[2] ..... A47L 11/30

[58] Field of Search ..... 15/50 R, 50 C, 52, 98, 15/320, 322, 401, 359; 118/108, 207; 401/5, 13; 404/111

[56] References Cited

UNITED STATES PATENTS

| | | | |
|---|---|---|---|
| 1,263,396 | 4/1918 | Faustini | 15/320 |
| 3,065,490 | 11/1962 | Arones | 15/401 X |
| 3,197,798 | 8/1965 | Brown et al. | 15/320 |
| 3,283,675 | 11/1966 | Gifford et al. | 15/50 R X |

FOREIGN PATENTS OR APPLICATIONS

| | | | |
|---|---|---|---|
| 1,137,016 | 1/1957 | France | 15/320 |

*Primary Examiner*—Daniel Blum
*Attorney, Agent, or Firm*—Price, Heneveld, Huizenga & Cooper

[57] ABSTRACT

A floor treatment machine including a squeegee assembly having a squeegee blade adjustable for a desired angle of incidence between the blade and the floor. The squeegee assembly is pivotally mounted to a bracket for limited rotation about the longitudinal axis of the machine for tracking variations of the floor surface. The bracket to which the squeegee assembly is pivotally coupled in turn is swivel-coupled to a lifting platform by a pair of spaced support arms, each pivotally coupled between the lifting platform and the bracket to permit the squeegee assembly to follow behind the floor treatment machine as it changes direction. The lifting bracket is pivotally coupled to the machine frame and is coupled to squeegee elevating and lowering means including a compressible linkage for holding the squeegee in an operating position with a predetermined adjustable pressure of the squeegee blade against the floor surface while permitting rearward tilting of the machine with the squeegee in the operating position.

11 Claims, 12 Drawing Figures

FLOOR TREATMENT MACHINE

BACKGROUND OF THE INVENTION

The present invention relates to floor treatment machines and particularly to scrubbers having swing squeegee assemblies.

In such swing squeegee scrubbers, the squeegees are mounted at the rear of the scrubber so as to swing from side to side. As one turns a corner with the machine, the friction between the squeegee and the floor causes the squeegee to track to the inside and thereby follow the path of water which has been laid down on the floor by brushes at the front of the machine.

Not only is it desirable to have a squeegee which swings from side to side, but also it is desirable to have a squeegee which will tilt or pivot about the longitudinal axis or path which the machine follows. Also, it is desirable to have facility for raising and lowering the squeegee between inoperative and operative positions. Prior artisans have had difficulty in combining all of these functions into a swing squeegee assembly which can still be raised and lowered by some type of remote control. Mechanisms proposed have either been quite complicated or have involved expensive components such as universal joints.

Also, the complicated assemblies required for swing squeegees interfere to some extent with the ability of the operator to tilt the machine on its rear wheels to gain access to the cleaning brushes. Such access is necessary to change brushes, for example. The squeegee assembly either interferes with tipping the machine rearwardly or prevents it altogether when the squeegee is in its operative position. Indeed, one could conceivably damage the squeegee assembly by attempting to tip it rearwardly with the squeegee in its down or operative position.

Yet another difficulty encountered with swing squeegee assemblies is effecting proper adjustment of the angle of the squeegee with respect to the floor. Typically, the entire assembly has to be adjusted in order to adjust this angle. This makes it extremely difficult if not impossible to adjust the angle during the life of the machine, which adjustment sometimes becomes necessary as a result of wear on the squeegee blade. Only one prior art proposal is known which even suggests providing for adjusting the angle of the squeegee with respect to the floor and this is a relatively complex arrangement in which a pivotally mounted squeegee has an upwardly projecting lever portion with a set screw projecting from either side of the lever for positioning it by adjusting the oppositely disposed set screws.

SUMMARY OF THE INVENTION

The apparatus of the present inventon, however, includes squeegee mounting structure which overcomes the deficiencies of known floor treatment machines and provides controlled tracking of the squeegee blade with respect to both the floor and movement of the machine. In one aspect of the present invention, means are provided to permit adjustment of the angle of incidence between the squeegee blade and the floor surface. Such means include a squeegee support plate, a support mounting bracket, pivot means between the plate and bracket, and fastening means spaced on opposite sides of the pivot means such that the squeegee blade may be adjustably tilted to adjust the angle of incidence.

Floor treatment apparatus of the present invention may also include squeegee mounting means permitting restricted pivoting of the squeegee assembly about the longitudinal axis of travel of the machine and a means for coupling the pivoted squeegee assembly to the machine for permitting lateral shifting of the squeegee assembly for tracking the motion of the treatment machine.

Apparatus also embodying the invention include a floor treatment machine having a squeegee assembly which is coupled to the machine by elevating and lowering means including a compressible member permitting the squeegee to be elevated to a nonoperative position and lowered to a yieldable operating position under a controlled pressure and permitting the machine to be tilted with the squeegee in operating position.

The present invention, its advantages and operation can best be understood by referring to the following description thereof together with the drawings in which:

DETAILED DESCRIPTION OF THE PREFERRED EMBODIMENT

Figure 11:
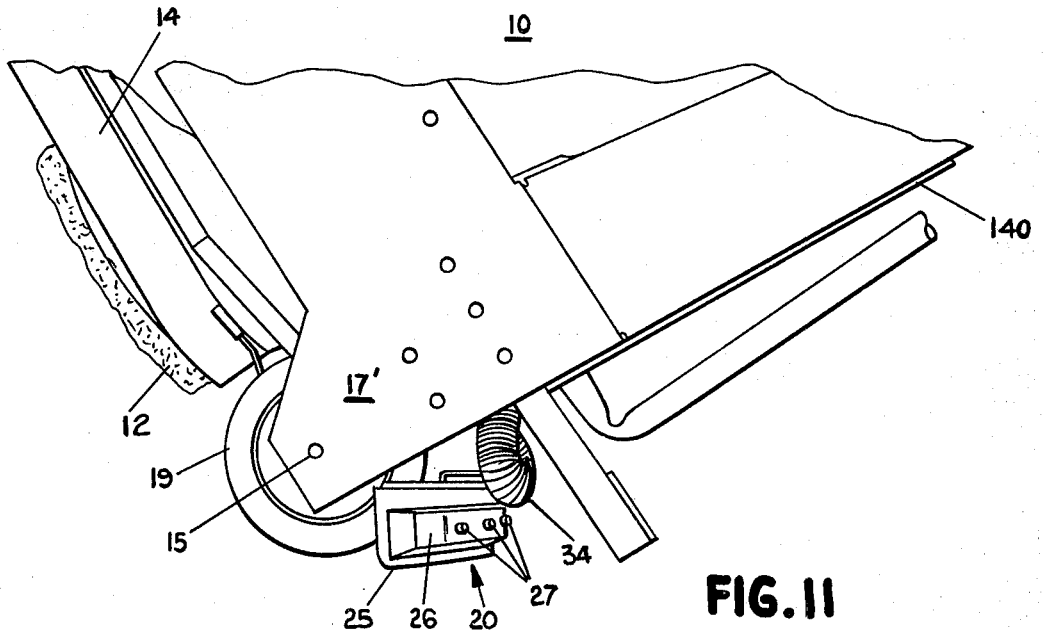
FIG. 11 is a fragmentary perspective view of the apparatus shown in FIG. 10.
Figure 1:
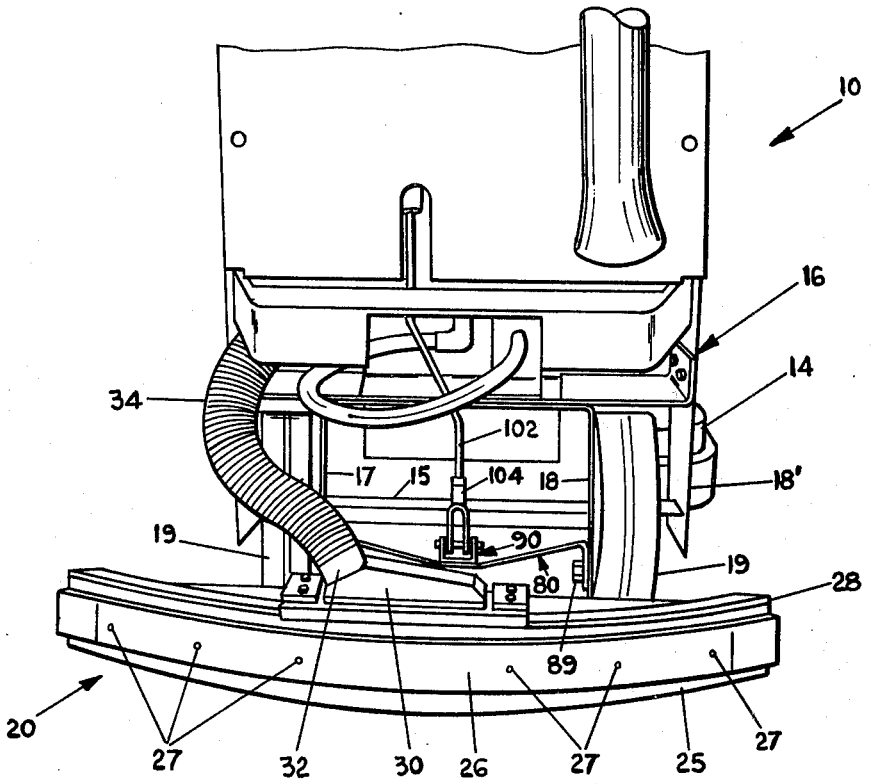
FIG. 1 is a fragmentary rear perspective view of a floor scrubbing machine embodying the present invention.

The floor scrubbing machine 10 of the present invention includes, as best seen in FIGS. 1 and 11, two circular scrubbing or polishing brushes 12 mounted under a housing 14 which supports a drive motor (not shown) for rotating brushes 12. Housing 14 is suitable coupled to the machine frame 16. Frame 16 includes, as seen in FIG. 1, a pair of downwardly depending substantially vertical rear support brackets 17 and 18. An axle 15 extends between brackets 17 and 18 and outwardly therefrom to left and right side main frames 17′ and 18′ respectively. Rotatably mounted to axle 15 on opposite ends thereof and between members 17 and 18 and the associated main frames is a pair of support wheels 19. Wheels 19 permit, together with forward support wheels (not shown), the floor scrubber 10 to be moved along the surface of a floor with relative ease and support the scrubbing mechanism as well as partially supporting the improved squeegee mechanism of the machine.

Figure 8:
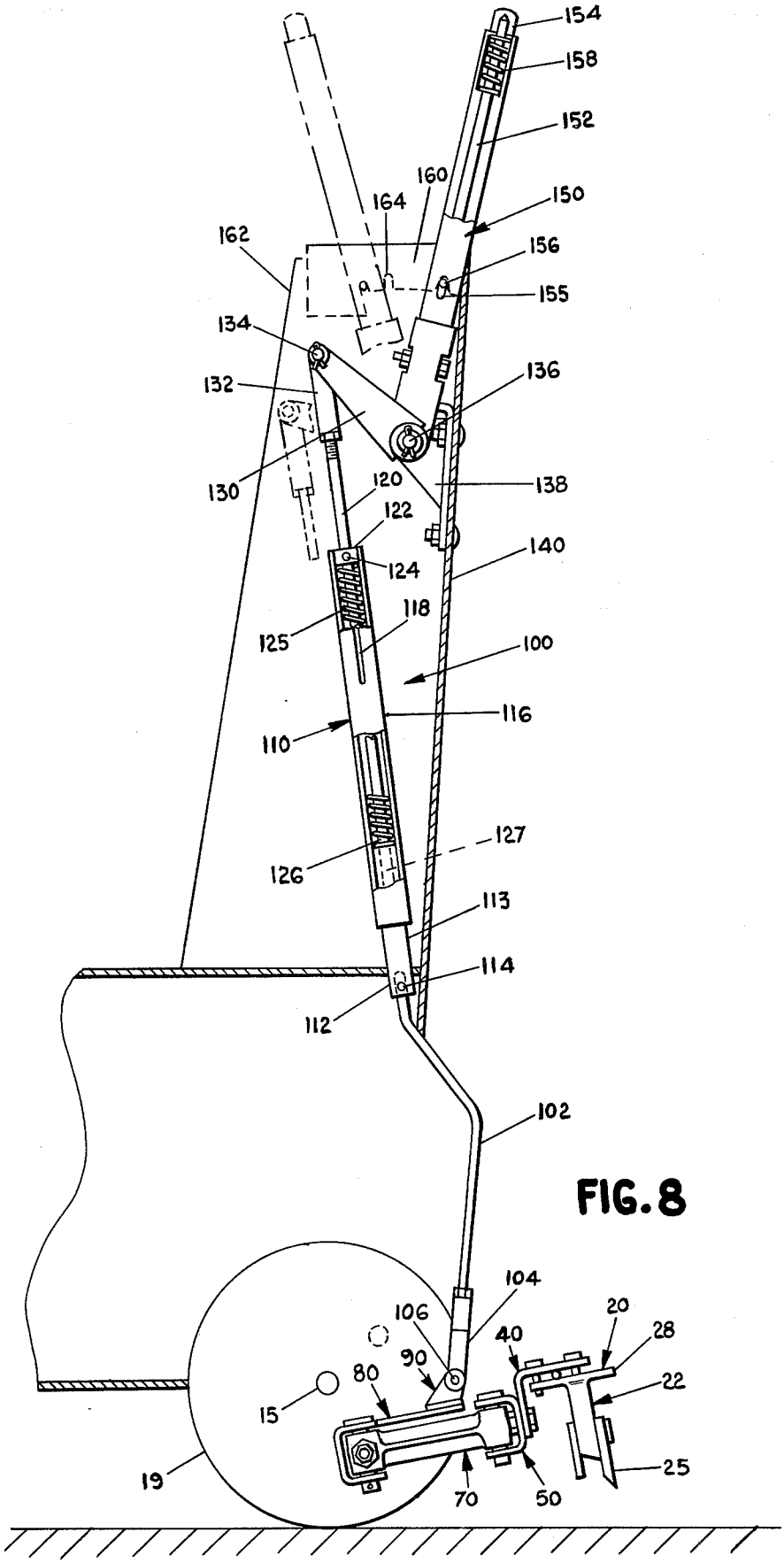
FIG. 8 is a fragmentary left side elevational view, partly in schematic form, of the squeegee elevating and lowering mechanism for the machine and shown in the squeegee elevated position.

The squeegee assembly and elevating and lowering mechanism therefor basically comprise, as seen in FIG. 8, a control arm 100 including a compressible linkage 110 therein which extends between a lifting bracket 80 and a pivotally moved control handle 150 for raising and lowering the lifting bracket which is pivotally coupled to the machine frame. Extending rearwardly from the lifting bracket is a pair of horizontally pivotable support arms 70, each pivotally mounted at one end to the lifting bracket and pivotally mounted at an opposite end to a pivot mounting bracket 50. A squeegee assembly support bracket 40 is pivotally mounted to bracket 50 for permitting side-to-side rocking action of the squeegee assembly 20 as well as side-to-side swing movement thereof to facilitate tracking of a squeegee blade 25 behind the floor scrubbing machine and permit the squeegee blade to follow the surface contours of the floor on which the machine is employed.

The squeegee assembly 20 is adjustably mounted to the squeegee assembly support bracket 40 permitting adjustment of the incident angle between the squeegee blade and the floor surface to optimize the squeegee action provided by the blade. Having briefly described the salient mounting features of the squeegee assembly and its elevating and lowering mechanism, a detailed description of the structure is now presented with reference to the detailed figures.

Figure 2:
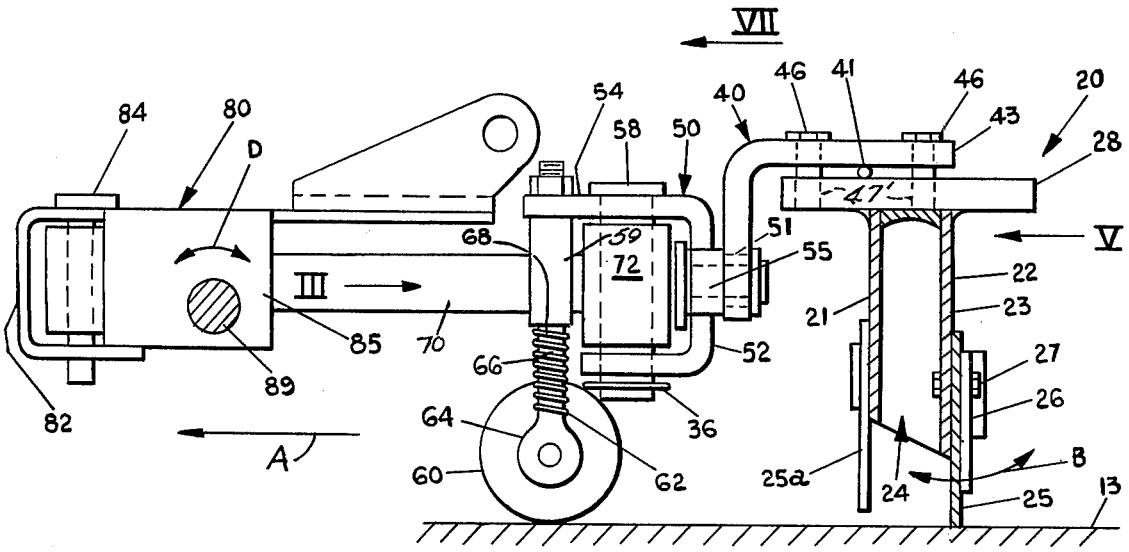
FIG. 2 is an enlarged left side elevational view, partly in cross section, of the squeegee mechanism employed with the machine shown in FIG. 1.
Figure 4:
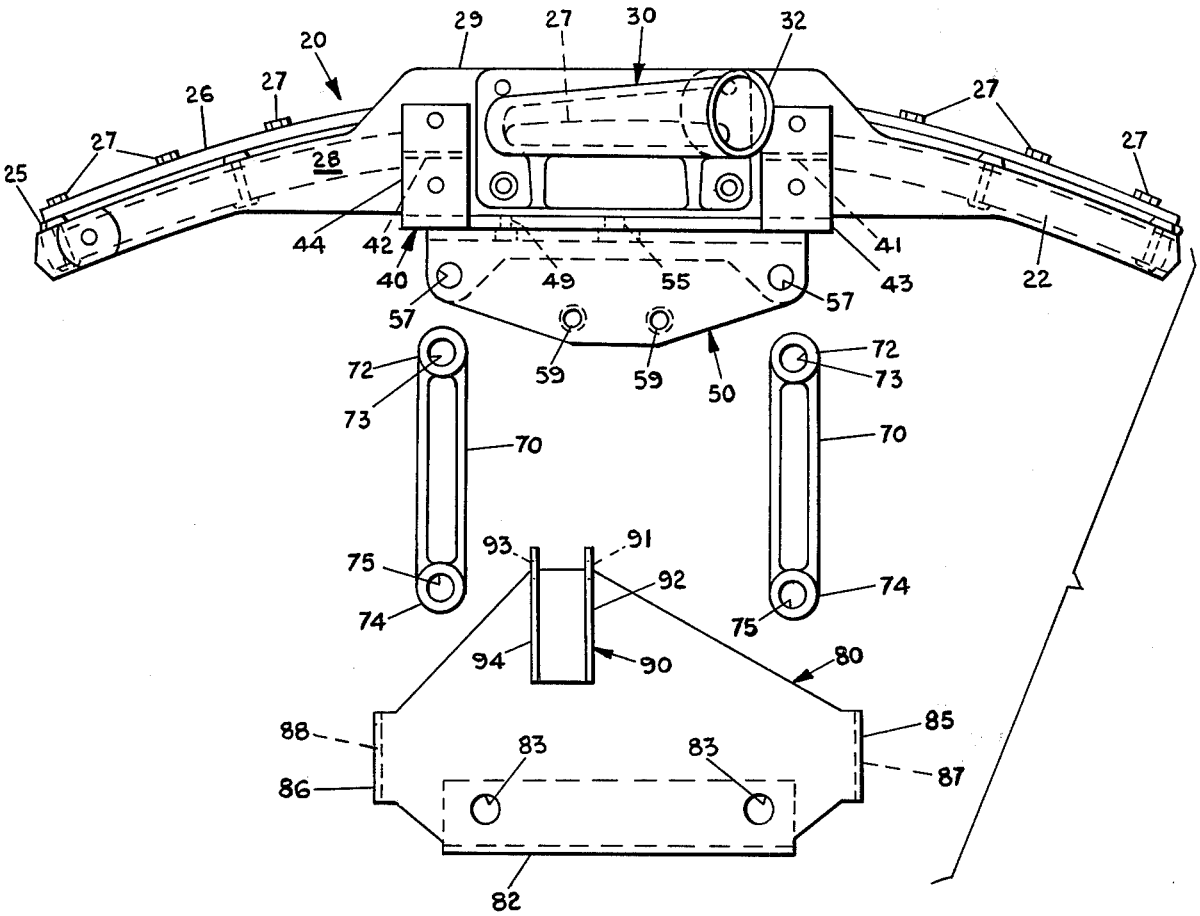
FIG. 4 is a partly exploded top plan view of the squeegee mechanism shown in FIG. 2.

Referring specifically now to FIGS. 1, 2 and 4, the squeegee assembly 20 includes an arcuate-shaped suction nozzle 22 of cast material such as aluminum. Nozzle 22 is a generally channel-shaped member with downwardly depending front and rear walls 21 and 23, respectively, joined at the ends to form the nozzle with a throat 24 opening downwardly. A squeegee blade 25 comprising a relatively stiff yet flexible rubber or polymeric material such as butadiene is attached to the lower portion of the rear wall 23 of housing 22 by means of a backing plate 26. A front flap 25a is spaced slightly above the floor to allow suds to be drawn thereunder. A plurality of spaced mounting bolts 27 compressibly hold the squeegee blade between the nozzle wall 23 and backing plate 26. During motion of the machine in a direction indicated by arrow A in FIG. 2, the arcuate squeegee blade wipes the surface of the floor collecting fluid dispensed by the floor scrubber and positioning it under the open throat of nozzle 22.

Nozzle 22 includes a nozzle support plate 28 enlarged to a rectangular center area 29. Nozzle 22 and plate 28 include an elongated aperture 27 (FIG. 4) through the top thereof providing communication between the nozzle and a vacuum housing 30. Housing 30 is sealably bolted to the central area of plate 28 and includes a cylindrical extension 32 extending therefrom. A pickup hose 34 (FIG. 1) is coupled to extension 32 and couples nozzle 22 to a vacuum motor for drawing fluid collected by the squeegee blade 25 into a holding tank (not shown).

The combined nozzle and squeegee 22 is adjustably mounted to a squeegee assembly support bracket 40 to permit tilting (as indicated by arrow B in FIG. 2) of the squeegee blade in a vertical plane to a fixed but adjustable angle between the blade and a floor surface 13. This tilting adjustment is provided by means of a pair of cylindrical pivot rods 41 and 42 welded to the undersurface of rearwardly extending forks 43 and 44, respectively, of bracket 40 (FIGS. 2 and 4).

Figure 5:
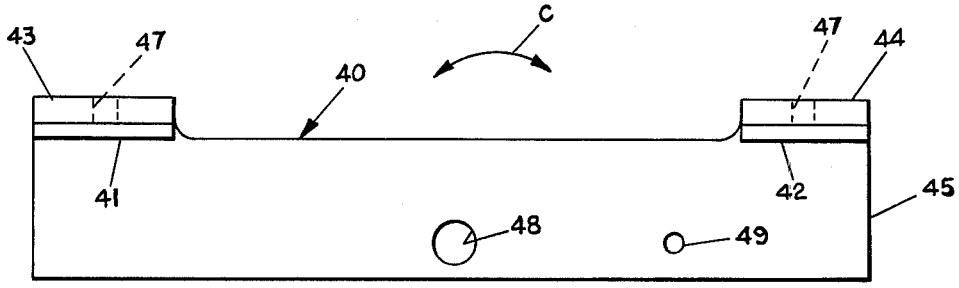
FIG. 5 is an enlarged rear elevational view of the squeegee assembly support bracket shown in FIG. 2 viewed from the direction indicated by arrow V in FIG. 2.

As seen in FIGS. 2, 4 and 5, bracket 40 comprises a vertical wall 45 with forks 43 and 44 extending horizontally and rearwardly from the top edge of wall 45 and spaced to permit the forks to span housing 30 as seen in FIG. 4. The tilt adjustment is provided by means of a pair of adjustment screws 46 extending through a pair of apertures 47 formed through each of the forks to span the pivot rods. Screws (or bolts) 46 threadably engage threaded apertures 47′ (FIG. 2) formed in plate 28 for attaching plate 28 to bracket 40. By simultaneously tightening the screws on one side of each of the rods 41 and 42 and loosening the bolts on the opposite sides thereof, support plate 28, to which the squeegee blade is coupled by means of the nozzle, can be tilted to achieve the desired angle of incidence between the squeegee blade and the floor surface. Wall 45 of bracket 40 includes a central aperture 48 and at least one forwardly projecting pin 49 (FIGS. 4 and 5). As described below, pin 49 is employed to restrict the pivotal motion of bracket 40 with respect to pivot mounting bracket 50 to which bracket 40 is mounted.

Figure 6:
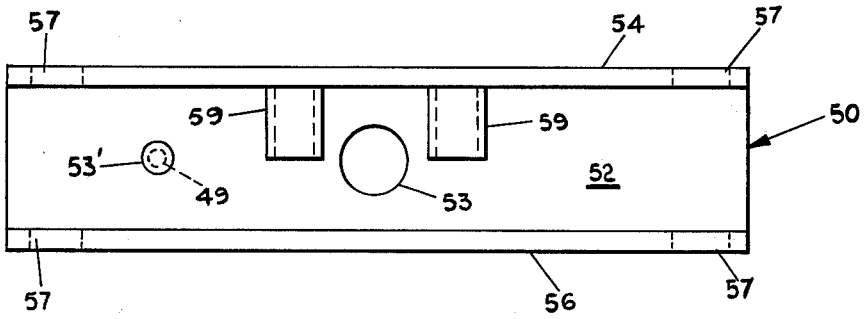
FIG. 6 is an enlarged front elevational view of the squeegee mounting bracket shown in FIG. 2 and viewed from the direction indicated by arrow III in FIG. 2.

Referring now to FIGS. 2, 4 and 6, bracket 50 comprises a channel member having a substantially U-shaped cross section with a center portion 52, an elongated upper flange 54, and a somewhat shorter lower flange 56. An aperture 53 extends through the center of member 52 and aligns with aperture 48 of bracket 40. A pivot shoulder spacer 55 (FIG. 2) extends between the members 40 and 50 and is suitably held in place. This will provide rotation (indicated by arrow C in FIG. 5) of bracket 40 with respect to bracket 50 in a substantially vertical plane and about the longitudinal axis of the machine.

The central portion 52 of bracket 50 includes an aperture 53′ spaced as seen in FIG. 6 to align with the forwardly extending pin 49 of bracket 40 such that the rotational motion of bracket 40 with respect to bracket 50 is restricted by the extension of pin 49 through the greater diameter aperture 53′. By enlarging or diminishing the diameter of aperture 53′, the relative rotational freedom of the squeegee assembly is selected to accommodate floor surface unevenness while still limiting the rotation of the squeegee assembly about the longitudinal axis of the floor scrubbing machine.

Figure 3:
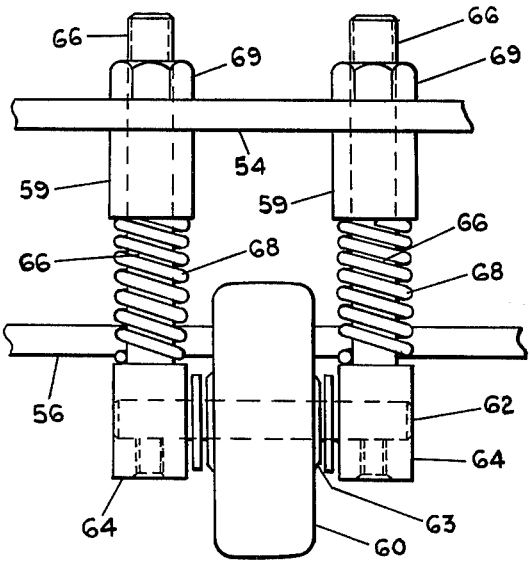
FIG. 3 is an enlarged fragmentary front elevational view of the support wheel assembly shown in FIG. 2 taken from the direction indicated by arrow III in FIG. 2.

Each end of bracket 50 includes a pair of apertures 57 extending through the upper and lower flanges thereof and which are aligned to permit a bolt 58 to extend vertically therethrough for attaching one end of each of a pair of support arms 70 to bracket 50 in pivotal relationship. In addition, bracket 50 includes a pair of mounting collars 59 welded to the lower surface of the forward edge of flange 54, as best seen in FIGS. 4 and 6, for mounting a support wheel 60 thereto as seen in FIG. 3.

Wheel 60 is rotatably mounted on an axle 62 by means of a bearing 63. Axle 62 is supported at opposite ends by means of mounting blocks 64. To permit the cushioned mounting of wheel 60 with respect to bracket 50, a pair of threaded shafts 66 extend upwardly from block 64 and are surrounded by bias springs 68 which extend between collars 59 and mounting block 64. Shafts 66 slidably extend through collars 59 and flange 54 and are secured by means of nuts 69 to permit upward motion of the wheel compressing springs 68. Thus, wheel 60 supports a portion of the weight of the squeegee assembly 20 and associated mounting mechanism in a cushioned fashion. The height of wheel 60 may be adjusted by loosening or tightening nuts 69 as required.

The pivot mounting bracket 50 is coupled to the lifting platform 80 to permit the pivot mounting bracket 50 and squeegee assembly mounted thereto to move laterally (i.e., shift from side to side) such that the squeegee blade will track the motion of the floor scrubbing machine as it travels around corners or otherwise changes directions. To provide the laterally shifting motion of the squeegee assembly, bracket 50 is coupled to bracket 80 by means of a pair of support arms 70 shown in FIGS. 2 and 4.

Each arm includes an enlarged collar 72 at one end with an aperture 73 extending therethrough and a collar 74 at an opposite end thereof including an aperture 75 extending therethrough. Each of the collars 73 is adapted to fit between the upper and lower flanges of mounting bracket 50, as shown in FIG. 2, to permit pivoting of the arm with respect to the bracket without any substantial vertical play. Likewise, the opposite end collars 74 are adapted to fit within a U-shaped frontal portion of the lifting platform 80 now described.

Figure 7:
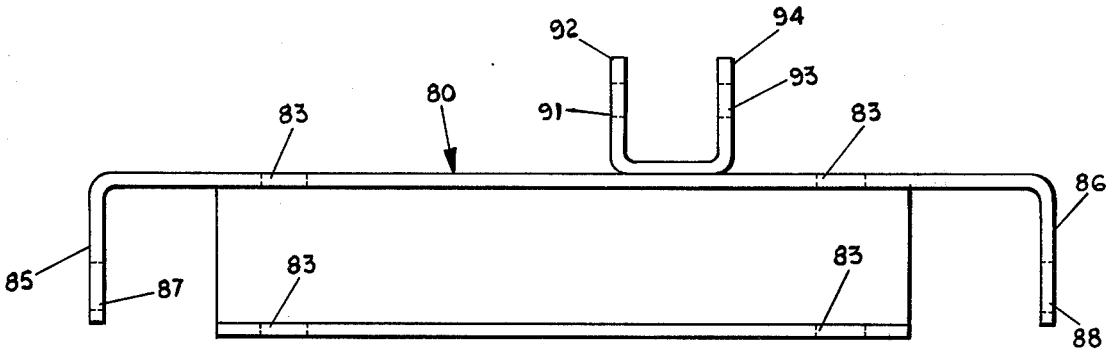
FIG. 7 is an enlarged rear elevational view of the squeegee lifting bracket shown in FIGS. 2 and 4 viewed from the direction indicated by arrows VII in FIG. 2.

Lifting platform 80 comprises, as best seen in FIGS. 2, 4 and 7, a plate formed with a downwardly and rearwardly projecting forward lip 82 with a pair of aligned apertures 83 formed downwardly therethrough on opposite sides thereof, as best seen in FIG. 7, to accommodate a pivot pin 84 (FIG. 2). Collars 74 of support arms 70 are thus pivotally held within the segment 82 of the platform. Platform 80 further includes a pair of downwardly depending side brackets 85 and 86 with apertures 87 and 88 therethrough, respectively, for pivotally mounting the bracket to the downwardly depending legs 17 and 18 of frame 16 of the machine as shown in FIG. 1. This is accomplished by means of pivot pins 89 extending through apertures 87 and 88 and into legs 17 and 18 permitting rotation of platform 80 about the axis of pins 89 as indicated by arrow D in FIG. 2.

Figure 10:
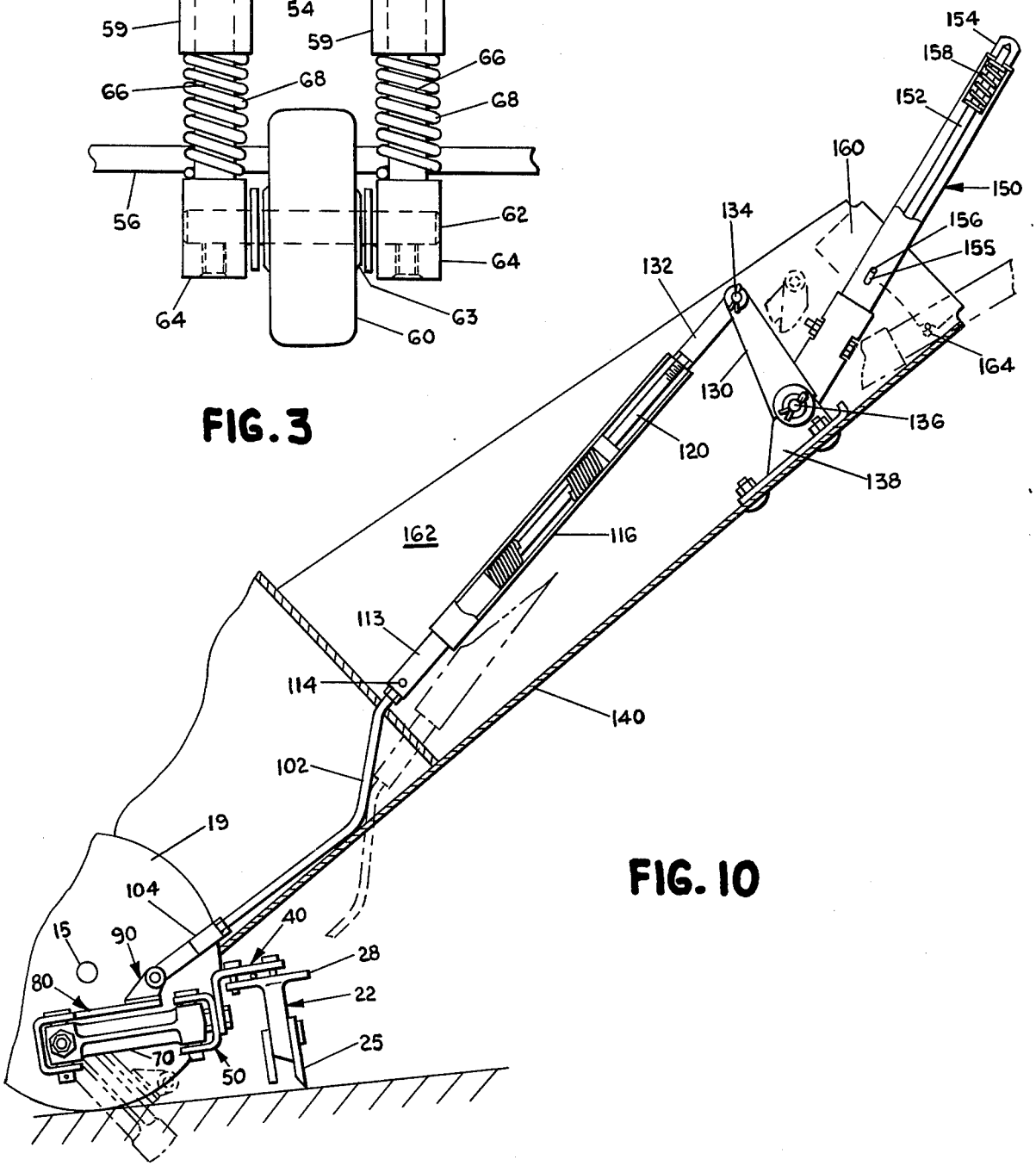
FIG. 10 is a left side elevational view of the apparatus shown in FIGS. 8 and 9 shown with the squeegee in a lowered position and the machine tilted rearwardly for permitting access to the scrubbing brush.
Figure 9:
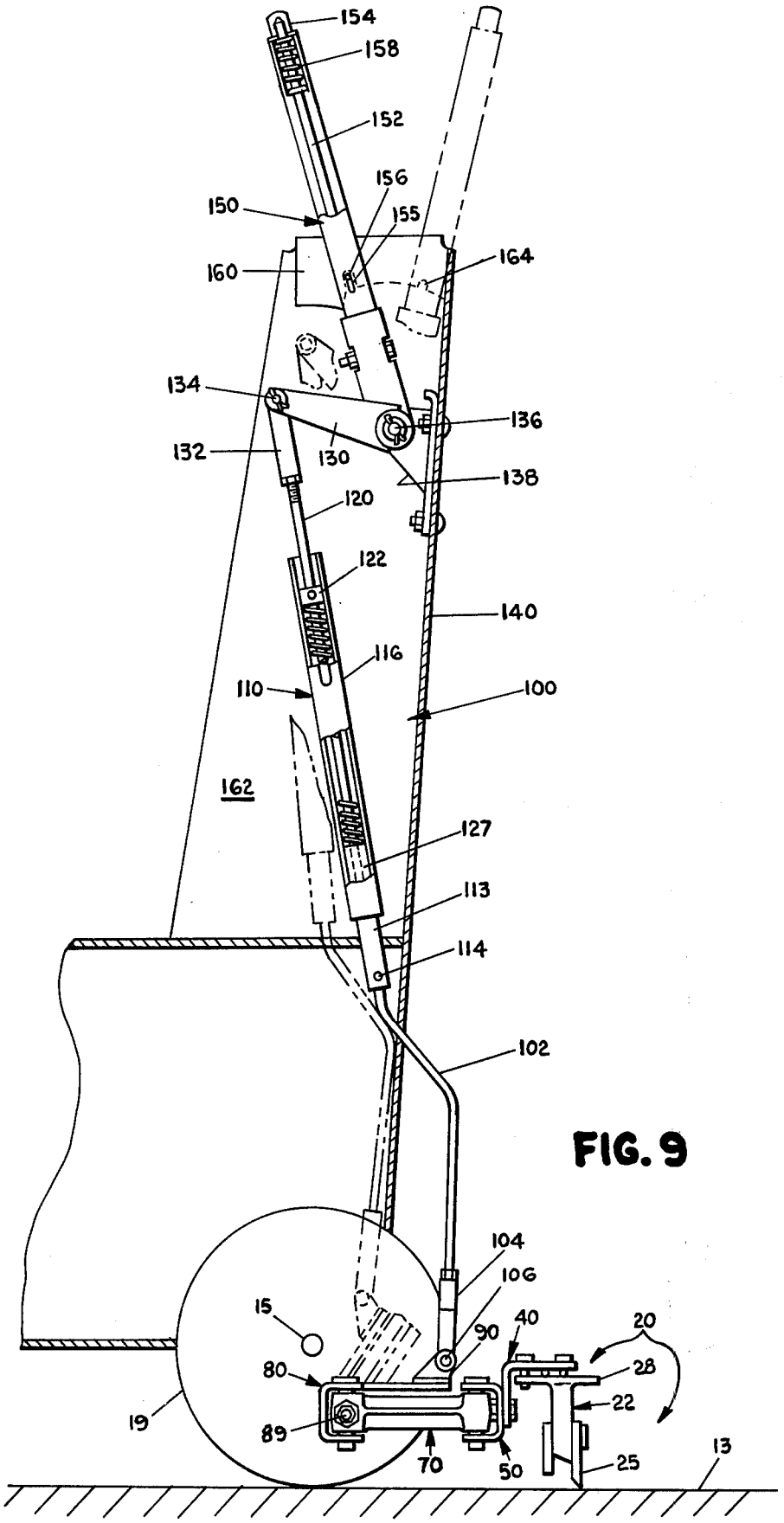
FIG. 9 is a fragmentary left side elevational view of the apparatus shown in FIG. 8 shown with the squeegee in a lowered position.

As shown in FIGS. 8–10, support arms 70 are fabricated such that the collars on opposite ends lie in the same vertical plane and lifting platform 80 is pivotally mounted at a lower position on the frame members 17 and 18.

Figure 12:
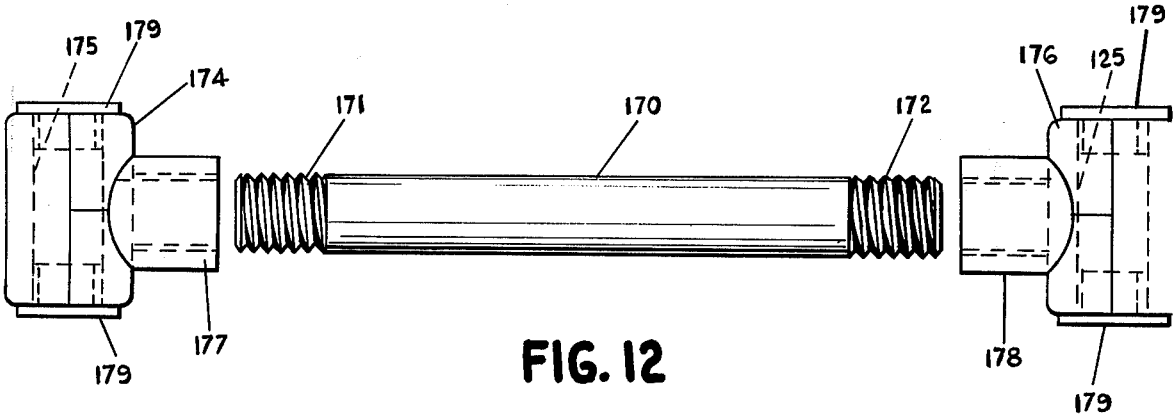
FIG. 12 is an enlarged exploded side elevational view of an embodiment of one of the support arms shown in FIGS. 2 and 4.

An alternative embodiment of the support arms extending between the lifting platform 80 and the pivotal mounting bracket 50 is shown in FIG. 12. In this embodiment, each of the support arms comprises a shaft 170 threaded at opposite ends 171 and 172. Collar members 174 and 176 include a threaded boss 177 and 178, respectively, which are adapted to thread the collars onto ends 171 and 172 of rod 170. Each of the collars also includes an aperture 175 extending vertically therethrough for pivotally coupling the arms to the flanges of bracket 50 and lifting platform 80 in the same manner as support arm 70 previously described. Collars 174 and 176, however, are loosely threaded to the ends of rod 170 to accommodate twisting motion between the squeegee assembly mounted to the support arms at one end and the lifting bracket coupled to the frame of the floor scrubber, and to prevent binding up of the arms. The provision of plastic bushings 179, made of nylon or the like, further prevents binding.

Since the squeegee assembly and pivot mounting plate 50 to which the squeegee assembly is mounted are coupled to platform 80 by means of arms 70, pivoting of the platform about pins 89 will elevate or lower the squeegee assembly between nonoperable and operable positions, respectively. The platform is coupled to elevating and lowering mechanism 100 (FIG. 8) by means of a bracket 90. Bracket 90 includes a pair of spaced upstanding walls 92 and 94, each having apertures 91 and 93, respectively, extending therethrough, as best seen in FIGS. 4 and 7, to permit coupling to the elevating and lowering mechanism described below. Bracket 90 is mounted to a rearwardly projecting extension of plate 80, as best seen in FIGS. 2 and 4.

The means for positively lowering the squeegee into an operable position while still permitting the machine to be tilted rearwardly for access to the scrubbing brush, and for elevating the squeegee to an inoperative position is best seen in FIGS. 8–11. The elevating and lowering means 100 comprises an offset arm 102 coupled at its lower end to bracket 90 by means of a clevis 104 and a pivot pin 106 extending between walls 92 and 94 of the bracket and through the clevis. The upper end of the offset arm 102 extends into an aperture 112 formed in the end of a lower narrowed portion 113 of a compressible linkage 110. Arm 102 is secured therein by means of pin 114.

The compressible linkage 110 comprises a hollow cylindrical body 116 having elongated notches 118 formed through opposite sides of the cylinder wall and extending from a top portion of the cylinder approximately one-third of the distance downwardly along the longitudinal axis of the cylinder. A plunger shaft 120 is coupled to a collar 122 by means of a pin 124 extending outwardly through notch 118 on either side of cylinder 116 to capture the movable collar within the travel limits defined by the length of notches 118. A bias spring 125 extends around rod 120 within cylinder 116 and is compressed between the lower face of collar 122 and a land 126 near the bottom of cylinder 116. Extending through land 126 into the lower portion of cylinder 116 is an aperture 127 having a diameter greater than the diameter of rod 120 to permit the rod to move inwardly and outwardly within cylinder 116. Collar 122 and rod 120 thus move in guided supported relationships within the cylinder and aperture 127, respectively.

In FIG. 8, the squeegee assembly 20 is shown in an elevated nonoperable position in which rod 120 is fully extended from cylinder 116 whereupon pin 124 abuts against the upper edge of notch 118 as seen in the figure. Rod 120 is coupled to a connecting linkage 130 by means of a clevis 132 and pivot pin 134 coupled to the upper end of the rod. Linkage 130 is welded at its opposite end to a rotatable axle 136. Axle 136 is rotatably supported between the spaced walls of a mounting bracket 138 bolted to the rear flange 140 of the side frame on each side of the machine. Also, welded to axle 130 is a control handle 150 including a spring-loaded rod 152 terminating at its upper end at a push button 154. A pin 156 coupled to rod 152 extends outwardly through a notch 155 formed in the hollow arm handle. A bias spring 158 forces rod 152 upwardly to hold pin 156 against the upward portion of the notch 155 as shown.

A control handle quadrant locking plate 160 is suitably welded to a side frame 162 of the floor scrubber and includes a plurality of spaced notches through a lower edge thereof which are positioned to be engaged by pin 156. Thus, control handle 150 can be locked in a predetermined rotated position and is shown in a raised position in FIG. 8.

To lower the squeegee and nozzle into the position shown in FIG. 9, push button 154 is depressed, moving pin 156 downwardly to clear the locking notches 164 on plate 160 and control arm 150 is rotated forwardly to one of the two available squeegee lowered and locked positions as indicated by the forward notches in plate 160. As control handle 150 is rotated forwardly, the compressible linkage 110 applies a predetermined positive downward force through offset link 102 to pivot the lifting platform 80 about its pivot mounting 89 such that squeegee blade 25 contacts the floor surface 13 with a predetermined force determined in part by the spring constant of spring 125. Button 154 is released to lock arm 150 in the forward position. In this lowered position, spring 125 will be partially compressed, as seen in FIG. 9, and collar 122 coupled to rod 120 will move downwardly within the cylinder 116 as seen in FIG. 9. Plunger 120 will also move within the aperture 127 near the bottom of cylinder 116. It is noted here that the spring-biased support wheel 60 will offer an adjustable and controlled bias force which permits the squeegee to be secured in a downward position held against vertical motion by the biasing of spring 125 and the springs 68 associated with wheel 60. If desired, the force of squeegee blade 25 against floor surface 13 can be increased by moving control handle 150 to its forwardmost position as indicated in phantom lines in FIG. 8.

One advantage of using the compressible linkage 110 in addition to providing a controlled force of the squeegee against the floor surface is that in the event the scrubbing machine is tilted rearwardly while the squeegee is in a lowered position, as seen in FIGS. 10 and 11, the squeegee assembly will tilt upwardly since the spring 125 is not in its fully compressed condition when the squeegee is in a lowered position and rod 120 can extend even further within the cylinder 116 as best seen in FIG. 10. This arrangement prevents damage to the squeegee mechanism and its associated lowering and elevating mechanism in the event the machine is tilted rearwardly for access to the scrubbing brushes 12 as seen in FIGS. 10 and 11.

Thus, it is seen that the squeegee mechanism of the present machine includes mounting means providing tilting adjustment of the squeegee and squeegee rotation and lateral movement to track floor surface unevenness and the motion of the machine. The squeegee is controllably held in an operable position at a predetermined pressure against the floor by elevating and lowering means which permits rearward tilting of the machine for access to the scrubbing or polishing element.

It will become apparent to those skilled in the art that various modifications to the preferred embodiment can be made which will fall within the spirit and scope of the invention as defined by the appended claims.

The embodiments of the invention in which an exclusive property or privelege is claimed are defined as follows:

1. In a floor treatment machine including a squeegee for contacting a floor surface to be treated, improved means for mounting said squeegee such that it tracks the movement of the floor treatment machine comprising:

a squeegee assembly including a squeegee blade for contacting the surface of the floor;

a pivot mounting bracket;

means pivotally coupling said squeegee assembly to said pivot mounting bracket for restricted pivotal motion about the longitudinal axis of motion of the floor treatment machine, said coupling means includes a pin extending between said pivot mounting bracket and said squeegee assembly, said pin spaced from the pivot axis between said pivot mounting bracket and said squeegee assembly and an aperture formed in one of said bracket or assembly to receive said pin, said aperture dimensioned larger than said pin to permit controlled pivoting of said squeegee assembly;

a lifting bracket pivotally coupled to the floor treatment machine for rotation about an axis transverse to the motion of said machine; and second means pivotally coupling said lifting bracket and said pivot mounting bracket to permit said squeegee assembly to swing laterally to follow the movement of said floor treatment machine.

2. The apparatus as defined in claim 1 wherein said squeegee assembly includes support wheel means mounted thereto for engaging the floor to be treated, said support wheel means including bias means permitting controlled vertical motion of said wheel with respect to said squeegee blade.

3. The apparatus as defined in claim 2 and further including lifting means coupled to said lifting bracket for elevating said squeegee assembly to an inoperative position and lowering said squeegee into an operative position.

4. In a floor treatment machine including a squeegee for contacting a floor surface to be treated, improved means for mounting said squeegee such that it tracks the movement of the floor treatment machine comprising:

a squeegee assembly including a squeegee blade for contacting the surface of the floor and wherein said squeegee assembly includes support wheel means mounted thereto for engaging the floor to be treated, said support wheel means including bias means permitting controlled vertical motion of said wheel with respect to said squeegee assembly;

a pivot mounting bracket;

means pivotally coupling said squeegee assembly to said pivot mounting bracket for restricted pivotal motion about the longitudinal axis of motion of the floor treatment machine;

a lifting bracket pivotally coupled to the floor treatment machine for rotation about an axis transverse to the motion of said machine;

second means pivotally coupling said lifting bracket and said pivot mounting bracket to permit said squeegee assembly to swing laterally to follow the movement of said floor treatment machine; and lifting means coupled to said lifting bracket for elevating said squeegee assembly to an inoperative position and lowering said squeegee into an operative position wherein said lifting means includes bias means for applying a predetermined force against said lifting bracket when in a squeegee lowered position to provide a predetermined squeegee blade contact pressure against the floor to be treated.

5. The apparatus as defined in claim 4 and further including means for selectively locking said lifting means in one of a plurality of squeegee lowered positions.

6. The apparatus as defined in claim 5 wherein said bias means associated with said lifting means permits said floor treatment machine to be tilted against said squeegee blade even when said squeegee blade is locked in a lowered position.

7. A floor treatment machine including a frame adapted to support floor treatment elements and be movable along the surface of the floor being treated, improved means for controlling the vertical position of a squeegee blade associated with the machine comprising:

a lifting bracket;

a squeegee assembly including a squeegee blade coupled to said lifting bracket;

means pivotally coupling said lifting bracket to the frame of the machine permitting raising and lowering of a portion of said bracket as it is pivoted;

elevating and lowering means including a linkage having a fixed member and a movable member coupled to said fixed member by bias means permitting relative motion between said fixed and movable members wherein said fixed member of said linkage comprises a cylindrical member having one end coupled to said lifting bracket and wherein said movable member comprises a rod extending into said cylindrical member at an opposite end thereof, said squeegee assembly including a vertically movable support wheel biased downwardly in a floor contacting position to partially counteract the bias force of said linkage such that said squeegee blade is held to the floor by a controlled pressure said elevating and lowering means coupled to said lifting bracket remote from its pivot coupling to said frame for actuating said elevating and lowering means between a squeegee elevated and a squeegee lowered position whereupon in said squeegee lowered position, said floor treatment machine can be tilted to compress said elevating and lowering means permitting access to the undersurface of said machine even when the squeegee is in a lowered position; and a movable control handle with the end of said rod remote from said cylindrical member coupled to said control handle, said control handle including means for locking said control handle in a selected position to maintain said squeegee blade in a desired position.

8. A floor treatment machine including a frame adapted to support floor treatment elements and be movable along the surface of the floor being treated, improved means for controlling the vertical position of a squeegee blade associated with the machine comprising:

a lifting bracket;

a squeegee assembly including a squeegee blade coupled to said lifting bracket and means for adjusting the angle of incidence of said squeegee blade to the floor;

means pivotally coupling said lifting bracket to the frame of the machine permitting raising and lowering of a portion of said bracket as it is pivoted;

elevating and lowering means including compressible means, said elevating and lowering means coupled to said lifting bracket remote from its pivot coupling to said frame for actuating said elevating and lowering means between a squeegee elevated and a squeegee lowered position whereupon in said squeegee lowered position, said floor treatment machine can be tilted to compress said compressible means permitting access to the undersurface of said machine even when the squeegee is in a lowered position, wherein said elevating and lowering means includes a movable control handle and wherein said compressible means comprises a linkage having a fixed member and a movable member coupled to said fixed member by bias means permitting relative motion between said fixed and movable members, and wherein said squeegee assembly includes a vertically movable support wheel biased downwardly in a floor contacting position to partially counteract the bias force of said linkage such that said squeegee blade is held to the floor by a controlled pressure, and wherein said fixed member of said linkage comprises a cylindrical member having one end coupled to said lifting platform and wherein said movable member comprises a rod extending into said cylindrical member at an opposite end thereof, the end of said rod remote from said cylindrical member coupled to said control handle; and means for locking said control handle in a selected position to maintain said squeegee blade in a desired position.

9. The apparatus as defined in claim 8 wherein said means coupling said squeegee assembly to said lifting bracket permits lateral motion of said squeegee blade to track the motion of said floor treatment machine.

10. A floor treatment machine including a frame adapted to support floor treatment elements and be movable along the surface of the floor being treated, improved means for controlling the vertical position of a squeegee blade associated with the machine comprising:

a lifting bracket;

a squeegee assembly including a squeegee blade coupled to said lifting bracket, said squeegee assembly including squeegee mounting means and squeegee support means wherein said squeegee support means includes a generally flat support plate and said squeegee mounting means includes a generally flat mounting plate, pivot means positioned between said support means and said mounting means wherein said pivot means comprises a rod positioned between said mounting plate and said support plate and extending transversely to the direction of movement of said floor treatment machine adjustable fastening means spaced on opposite sides of said rod for varying the angle of incidence between said squeegee blade and a floor surface to be treated;

means pivotally coupling said lifting bracket to the frame of the machine permitting raising and lowering of a portion of said bracket as it is pivoted; and elevating and lowering means including compressible means, said elevating and lowering means coupled to said lifting bracket remote from its pivot coupling to said frame for actuating said elevating and lowering means between a squeegee elevated and a squeegee lowered position whereupon in said squeegee lowered position, said floor treatment machine can be tilted to compress said compressible means permitting access to the undersurface of said machine even when the squeegee is in a lowered position.

11. The apparatus as defined in claim 10 wherein said fastening means includes a pair of bolts threadably securing said support plate to said mounting plate, said bolts spaced on opposite sides of said rod.

* * * * *